United States Patent [19]

Ishida et al.

[11] Patent Number: 4,493,559

[45] Date of Patent: Jan. 15, 1985

[54] ANALOGUE ALARM ELECTRONIC TIMEPIECE

[75] Inventors: Takashi Ishida; Masaharu Shida, both of Tokyo, Japan

[73] Assignee: Seiko Instruments & Electronics Ltd., Tokyo, Japan

[21] Appl. No.: 369,312

[22] Filed: Feb. 7, 1980

[30] Foreign Application Priority Data

Feb. 9, 1979 [JP] Japan ..... 54-13985

[51] Int. Cl.[3] ..... G04B 23/02; G04B 19/04

[52] U.S. Cl. ..... 368/74; 368/80

[58] Field of Search ..... 368/72–74, 368/76, 80, 157, 160, 250, 251

[56] References Cited

U.S. PATENT DOCUMENTS

| | | | |
|---|---|---|---|
| 4,223,523 | 9/1980 | Kamijo | 368/74 |
| 4,259,737 | 3/1981 | Berney | 368/76 X |
| 4,266,288 | 5/1981 | Berney | 368/76 X |

*Primary Examiner*—Vit W. Miska

*Attorney, Agent, or Firm*—Robert E. Burns; Emmanuel J. Lobato; Bruce L. Adams

[57] ABSTRACT

Disclosed is an analogue alarm electronic timepiece having a time hand.

The time hand is used as both alarm setting time hand and time display hand.

The analogue alarm electronic timepiece comprises a reversible motor, an electronic circuit including a driving circuit for the reversible motor and means for counting and storing at least two kinds of relative time differences selected from the group consisting of the relative time difference between the present time and alarm time, the relative time difference between the alarm time and the display time, and the relative time differences between the alarm time and the display time, and an electronic acoustic transducer.

4 Claims, 24 Drawing Figures

ANALOGUE ALARM ELECTRONIC TIMEPIECE

BACKGROUND OF THE INVENTION

The present invention relates to an analogue alarm electronic timepiece which is simple in construction and which uses the time-indicating hands to set the alarm time.

FIG. 1 illustrates one example of a block diagram of the conventional analogue alarm electronic timepiece. An oscillating circuit 1 produces a high frequency signal as a time standard signal. A frequency dividing circuit 2 divides down the high frequency signal and produces a signal for operating the following circuits. A driving circuit 3 synthesizes an output signal from the frequency dividing circuit 2 and periodically generates driving pulses having suitable proper pulse width for driving a motor. A motor 4 converts the driving pulses into a rotary mechanical-motion. A display mechanism 5 has a gear train and time hands, and the display mechanism 5 transmits the motion of the motor 4 to the time hands and displays the time. An alarm time setting mechanism 7 is provided for setting and displaying an alarm time, and the setting and displaying operation is carried out by moving an alarm setting wheel or a sub-hand which is operated by the operator. A coincidence detecting mechanism 6 is a switch mechanism operated in relation to the display mechanism 5 and the alarm time setting mechanism 7 such that when the present time is coincident with a preset alarm time, the coincidence is detected in accordance with the ON-OFF condition of the switch mechanism and an electric signal is produced. An alarm circuit 8 synthesizes an alarm driving signal on the basis of the output signal from the frequency dividing circuit 2, and the circuit 8 outputs the alarm driving signal when the coincidence detecting mechanism 6 detects the fact that the present time is coincident with the alarm time. An electric-acoustic transducer 9 comprises a piezo-electric element or an electromagnetic speaker for converting the alarm driving signal into a sound signal by generating an audible sound.

The above mentioned analogue alarm electronic timepiece is disadvantageous in that since the mechanical constructions of the alarm time setting mechanism 7 and the coincidence detecting mechanism 6 are complex, it is difficult to obtain a small size timepiece or a thin type timepiece, and the cost is high. Moreover, since a special display device is required for setting and displaying the alarm time, this restricts the freedom of design for the outer design for a timepiece. Furthermore, in such an alarm electronic timepiece, since the coincidence detecting mechanism 7 is a mechanical switch, it is difficult to exactly set an alarm time in the time unit of minutes or seconds.

SUMMARY OF THE INVENTION

It is, therefore, an object of the present invention to provide an analogue alarm electronic timepiece which effectively overcomes the above described drawbacks in the conventional analogue alarm electronic timepiece.

It is another object of the present invention to provide an analogue alarm electronic timepiece which detects electrically whether or not an alarm time is coincident with the present time without using mechanical means.

It is another object of the present invention to provide an analogue alarm electronic timepiece wherein the time hands for normally indicating the time are used for setting and displaying the alarm time so that it is possible to exactly set the alarm time in the time unit of minute or second and to freely decide the design for the timepiece.

It is a further object of the present invention to provide an analogue alarm electronic timepiece constructed to easily enable the addition of an to advanced function, such as the function for setting and storing a plurality of alarm times.

It is a feature of the analogue alarm electronic timepiece of the present invention that in order to realize the above described objects, special indicating hands, a position detecting device and any similar devices are not required.

Other objects and features of the present invention will be more apparent from the following description when taken in conjunction with the accompanying drawings.

DETAILED DESCRIPTION OF THE INVENTION

Figure 1:
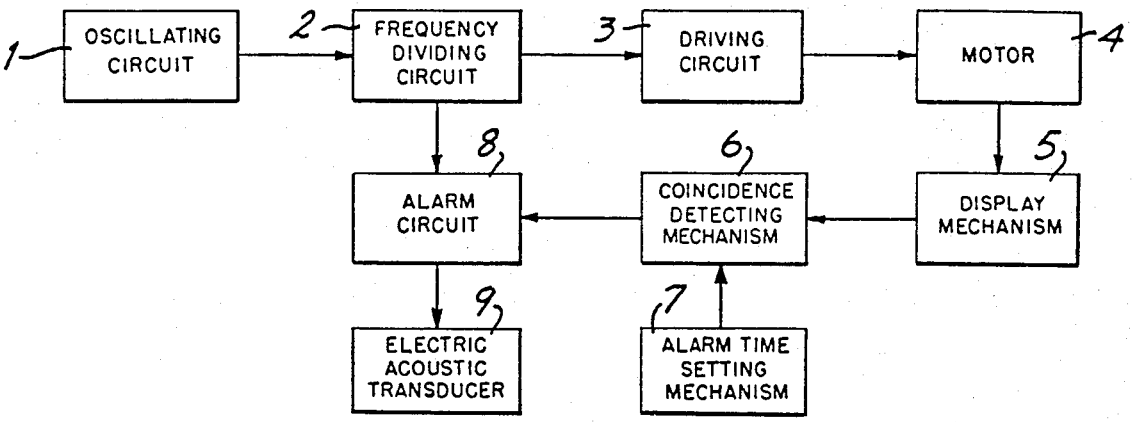
FIG. 1 PRIOR ART
FIG. 1 is a block diagram of the conventional analogue alarm electric timepiece.

Prior to the detailed explanation of the present invention, the operation and manipulation of the embodiments of the present invention will be generally described.

An analogue alarm electronic watch embodying the present invention has two time-indicating hands and these hands are incrementally moved every ten seconds. A time correcting operation and an alarm time setting operation are not achieved by directly operating a display mechanism by use of an outer-operation mechanism, but instead these operations are carried out by applying an electrical signal produced by the operation of the outer-operation mechanism (e.g., a winding stem 18 or button 19) to an electronic circuit and a motor and the time hands are moved in relation to the content of a counter in the electronic circuit.

When correction of the present time is required, the button 19 should be positioned at a first pull-out position and the winding stem 18 should be positioned at a second pull-out position. After these operation, the present time correction is carried out by rotating the winding stem. The motor rotates in the forward direction or the reverse direction in accordance with the rotational direction of the winding stem 18. As a result, the time hands rotate in the forward or reverse direction. Displaying and setting an alarm time can be carried out by rotating the winding stem 18 under the condition that the winding stem 18 is positioned at a first pull-out position and the button 19 is positioned at a second pull-out position in the same way as described above. When the button 19 is pulled out, a time hand 20 is moved from the position indicating the present time to the position indicating the alarm time, and then, the correcting operation for an alarm time can be carried out. At this time, the rotational direction of the time hand is automatically decided in such a way that the moving time thereof is the shortest. Although the motor is reversible, due to mechanical limitations, the time hand is moved at the rate of 128 steps/sec in the forward direction and the time hand is moved at the rate of 32 steps/sec in the reverse direction. Therefore, in order to minimize the time required for moving the time hand, the hand is rotated in the forward direction when the difference in time between the alarm time and the display time indicated by the hand is less than nine hours and thirty-six minutes, and is rotated in the reverse direction when the difference in time is more than that time. For the same reason, in the case that the button 19 is pushed to be positioned at the first pull-out position when displaying and setting the alarm time, the motor is rotated in the reverse direction when the difference in time between the display time indicated by the time hands and the present time is more than two hours and twenty-four minutes and the display time becomes the present time. When the difference is less than two hours and twenty-four minutes, the motor is rotated in the forward direction to display the present time. Consequently, in the case that the alarm time or the present time is displayed by using the same time hand, it is required to find the relative time differences among the alarm time, the present time and the display time indicated by the time hands (hereinafter referred to as a display time). However, it is not necessary to memorize the three kinds of relative time differences obtained from the three kinds of time. If any two kinds of the relative time difference are stored, the remaining one can be found by a simple calculation.

Moreover, it is not necessary to find the absolute value of the three kinds of the times.

Some embodiments of the present invention will be hereinafter described in more detail.

Figure 2:
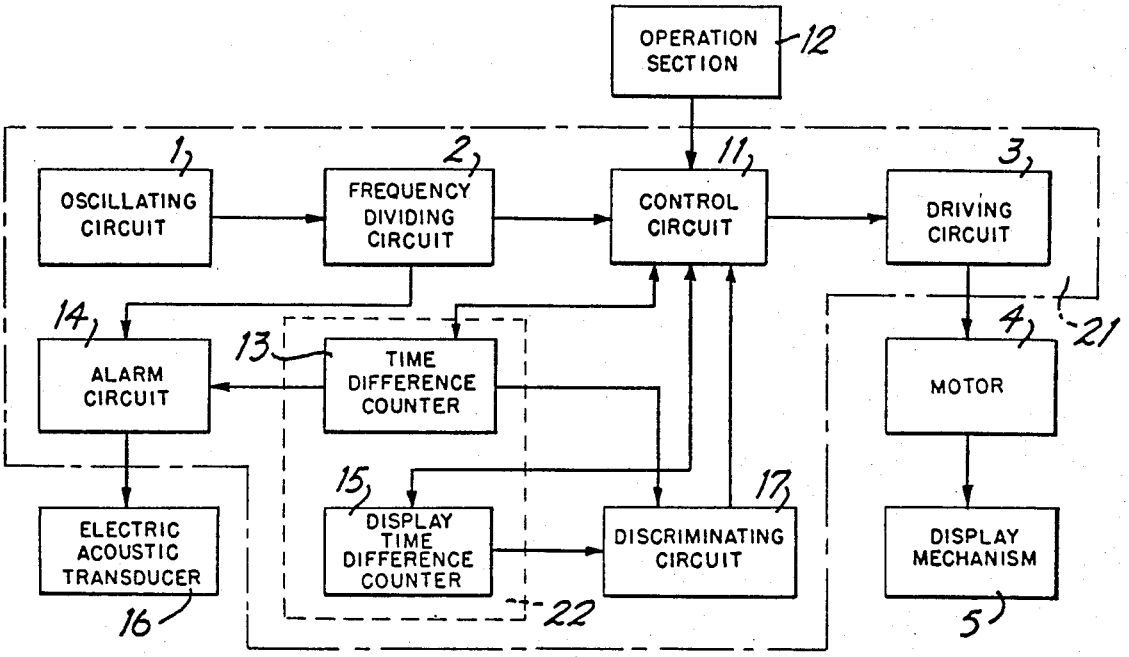
FIG. 2 is a block diagram of the first embodiment of an analogue alarm electric timepiece in accordance with the present invention.
Figure 3:
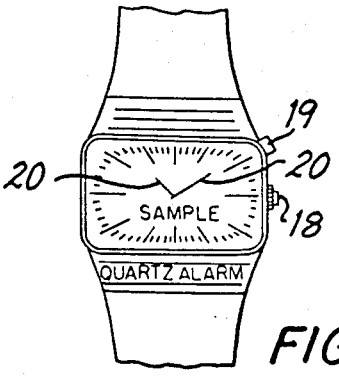
FIG. 3 is a general plan view of one example of an analogue alarm electric timepiece in accordance with the present invention.

Referring to FIG. 2, an oscillating circuit 1 is a high frequency signal source and is controlled by a quartz crystal. The high frequency signal is applied to a frequency dividing circuit 2 which divides down the high frequency signal to a lower frequency signal which is applied to the subsequent circuits. An operation section 12 produces an electronic signal in response to the operation of the winding stem 18, the button 19 or the like.

In a control circuit 11, either the present time correcting state or an alarm time setting state is judged from the signal from the operation section 12, and a time signal from the frequency dividing circuit 2 and the signals produced by operating the operation section are processed to control the circuitry described hereinafter. A time difference counter 13 is a 4320-counter for counting and storing the value corresponding to the difference in time between the alarm time and the present time. The value of 4320 is based on the following calculation;

$$12(\text{hour}) \times 60[\text{minutes}] \times 6[\text{steps/minutes}]$$

The content of the counter 13 is decreased or increased by correcting the present time or setting the alarm time and is decreased by one every time of the application of the time signal produced every 10 seconds.

A display-time difference counter 15 is a 4320-counter for calculating and storing the value corresponding to the difference in time between the display time and the present time, and the content of the counter is decreased or increased when the time hands are moved. In the alarm time displaying state, the counter counts down by one on response to each application of the time signal which is produced every 10 seconds. A discriminating circuit 17 has the function for discriminating whether or not the difference time between the content of the time difference counter 13 and the content of the display-time difference counter 15 is more that 3456 (which corresponds to nine hours and thirty-six minutes), the function for discriminating whether or not the content of the display-time difference counter is more than 864 (which corresponds to two hours and twenty-four minutes) and, the function for detecting whether or not the content of the time difference counter is coincident with the content of the display-time difference counter. An alarm circuit 14 synthesizes the output signals from the frequency dividing circuit 2 to produce an alarm driving signal, and outputs the alarm driving signal for a predetermined duration when the content of the time difference counter 13 becomes zero. An electric acoustic transducer 16 receives the alarm driving signal to produce an alarm sound.

A driving circuit 3 receives the output signals from the control circuit 11 to produce driving pulses for rotating a motor 4 in the forward or reverse direction. The mechanical output from the motor 4 is transmitted to the time hands via gears to display the time.

The oscillating circuit 1, the frequency dividing circuit 2, the control circuit 11, the driving circuit 3, a memory 22 comprised of the time difference counter 13 and the display-time difference counter 15, a discriminating circuit 17 and an alarm circuit 14, which are enclosed with a dash line 21, are all fabricated as a single electronic circuit.

The operation of the embodiment of the present invention will be described in conjunction with the detailed circuit arrangement. Since the oscillating circuit 1, the frequency dividing circuit 2, the electric acoustic transducer 16 and the display mechanism 5 are well known, a detailed description of these devices is omitted.

Figure 4:
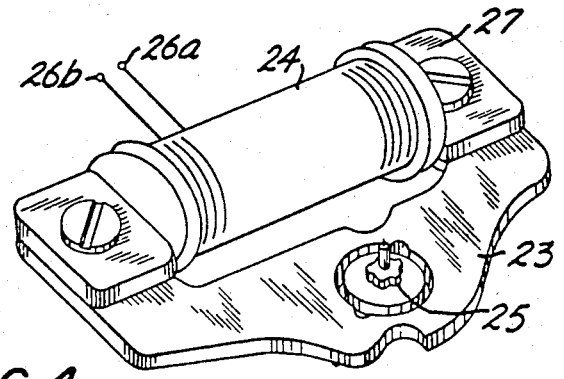
FIG. 4 is a perspective view of a motor used in the embodiment of the present invention.
Figure 5:
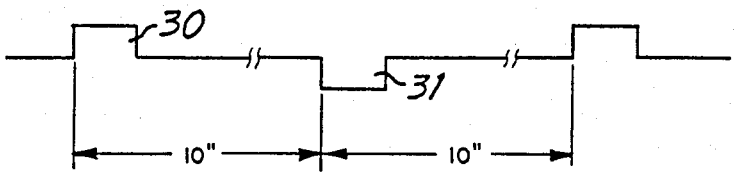
FIG. 5 is a waveform of a forward rotation driving signal for the motor.
Figure 6:
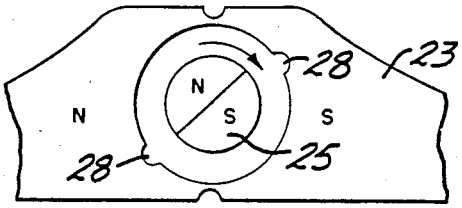
FIG. 6 is an illustrative view of the motor operation.

At first, one example of the reversible motor which is an important element in the present invention, will be described. FIG. 4 illustrates a perspective view of a stepping motor which is used in the present invention. The stepping motor has a coil 24, a magnetic core 27, a stator 23, and a rotor 25 having two magnetized poles. In order to decide the stational position of the rotor 25, as shown in FIG. 6, a pair of notches 28 are provided on the inner peripheral surface of the stator 23 which faces the rotor 25. Therefore, since the magnetic poles are produced in the stator 23 when the driving pulses illustrated by a reference numeral 30 in FIG. 5 are applied to the coil terminals 26*a* and 26*b*, the rotor 25 is rotated for 180° in the direction shown by an arrow mark. Similarly the reverse magnetic poles are produced in the stator 23 when driving pulses 31 of opposite polarity are applied to the coil and, the rotor 25 is further rotated for 180° in the same direction as that indicated by the arrow mark. As a result, the rotational position of the rotor 25 becomes the original position shown in FIG. 6. After this, it is possible to continue the rotating operation of the rotor 25 by sequentially applying the alternating pulse signal to the coil 24.

Hereinbefore, the forward rotating operation has been described.

Next, the driving operation of the motor in the reverse direction will be described.

Figure 7:
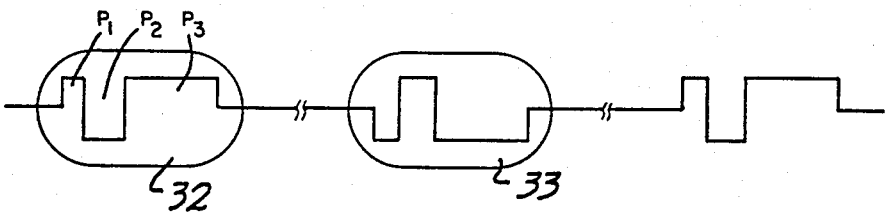
FIG. 7 is one example of a waveform of a reverse rotation driving signal for the motor.
Figure 8A:
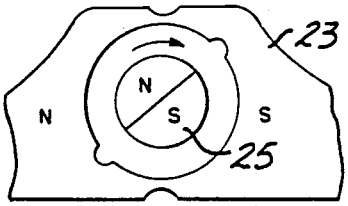
FIG. 8A, FIG. 8B, FIG. 8C and FIG. 8D are illustrative views of the reverse rotating operation of the motor.
Figure 8B:
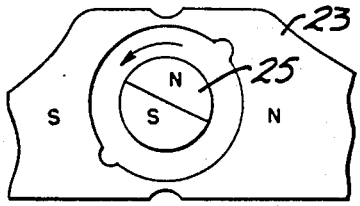
Figure 8C:
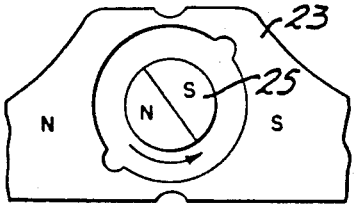
Figure 8D:
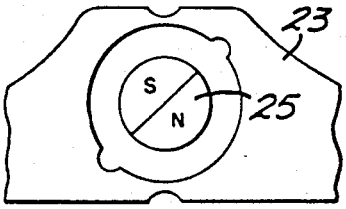

In FIG. 7, the waveform of a reverse direction driving pulse is illustrated. A series of pulses 32 including pulses $P_1$, $P_2$ and $P_3$ is used for rotating the motor in the reverse direction by one step increments. The rotor 25 starts to rotate in the forward direction by the application of the pulse $P_1$, as shown in FIG. 8A. Then, when the pulse $P_2$ is applied to the motor, the rotor 25 is once stopped and then starts to rotate in the reverse direction as shown in FIG. 8B. The application of the pulse $P_3$ aids the rotor 25 to rotate in the reverse direction. Finally, the rotor 25 is positioned in stable condition at the position shown rotated in the reverse direction for 180° from the position shown in FIG. 8A, and positioned in stable condition at the position shown in FIG. 8D. The rotor 25 is rotated in the reverse direction by the application of a reverse driving pulse train 33 which has an opposite polarity to the pulse train 32.

The operation of the driving circuit 3 will be described in conjunction with FIG. 9, FIG. 10A and FIG. 10B. A clock input terminal C of a D type flipflop is connected to an input terminal 48 and to input terminals of an AND gates 51 and 52. Output terminals Q and $\overline{Q}$ thereof are connected to the other input terminals of the AND gates 51 and 52, respectively, and a date input terminal D is connected to the terminal $\overline{Q}$. The output terminals of the AND gates 51 and 52 are connected to input terminals of Ex-OR gates 53 and 54, respectively. The other input terminals of the Ex-OR gates 53 and 54 are commonly connected to a terminal 49, and output terminals thereof are respectively connected to the input terminals of inverter 55 and 56. Output terminals of the inverter 55 and 56 are respectively connected to a coil 24 of the motor via terminals 26*a* and 26*b*.

Figure 10A:
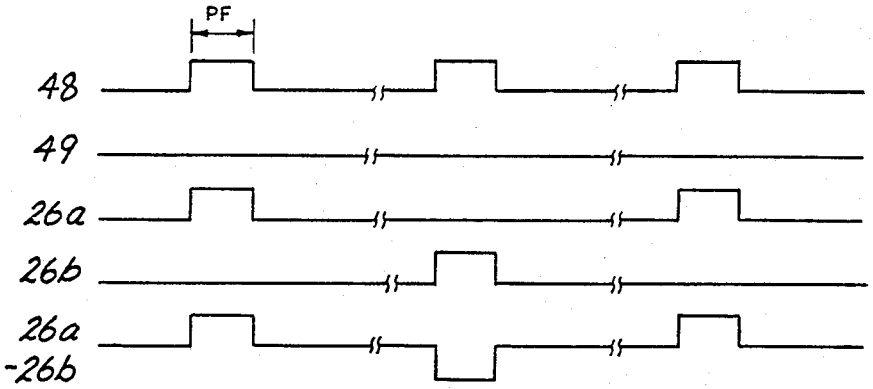
FIG. 10A and FIG. 10B are timing charts for illustrating the operation of the driving circuit.

FIG. 10A illustrates a timing chart at the time of the driving operation for forward rotation. The output level of the D type flipflop 50 is changed every time one pulse is applied to the input terminal thereof when the signals shown in FIG. 10A are applied to the terminals 48 and 49. As a result, the pulses with pulse width of PF shown by 26*a* and 26*b* of FIG. 10A are alternately applied to the coil terminals 26*a* and 26*b* from the inverters 55 and 56. The voltage applied to the coil 24 is equal to the potential difference between both end terminals of the coil, that is, the voltage difference between the voltage value of the outputs 26*a* and 26*b*. Consequently, the stepping motor is rotated in the forward direction in stepwise fashion.

Figure 10B:
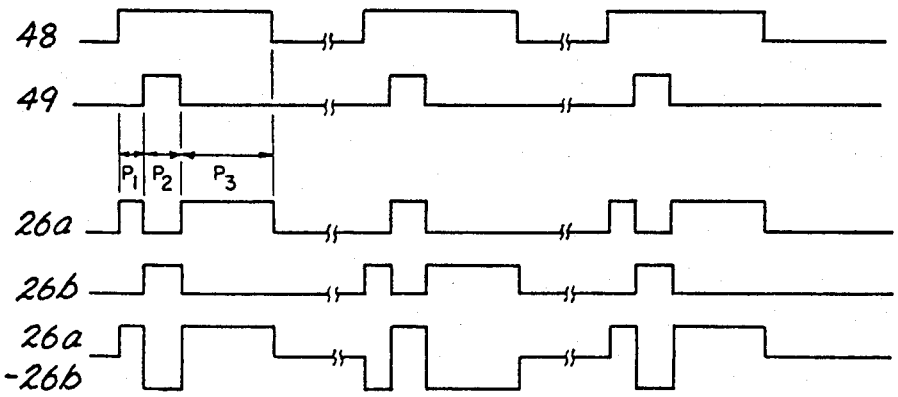

FIG. 10B illustrates a timing chart at the time of the reverse rotating operation of the stepping motor.

As in the case of the forward rotating operation, the output level of the D type flipflop 50 is changed every time when one pulse is applied to the terminal 48. However, since the output levels from Ex-OR gates 53 and 54 are inverted at the time of the rising edge of the pulses applied to the terminal 49, the driving pulse train having a waveform shown by the reference (26*a*–26*b*) of FIG. 10B is applied to the coil 24. Therefore, as described above, the motor is rotated in the reverse direction in stepwise fashion.

Figure 11:
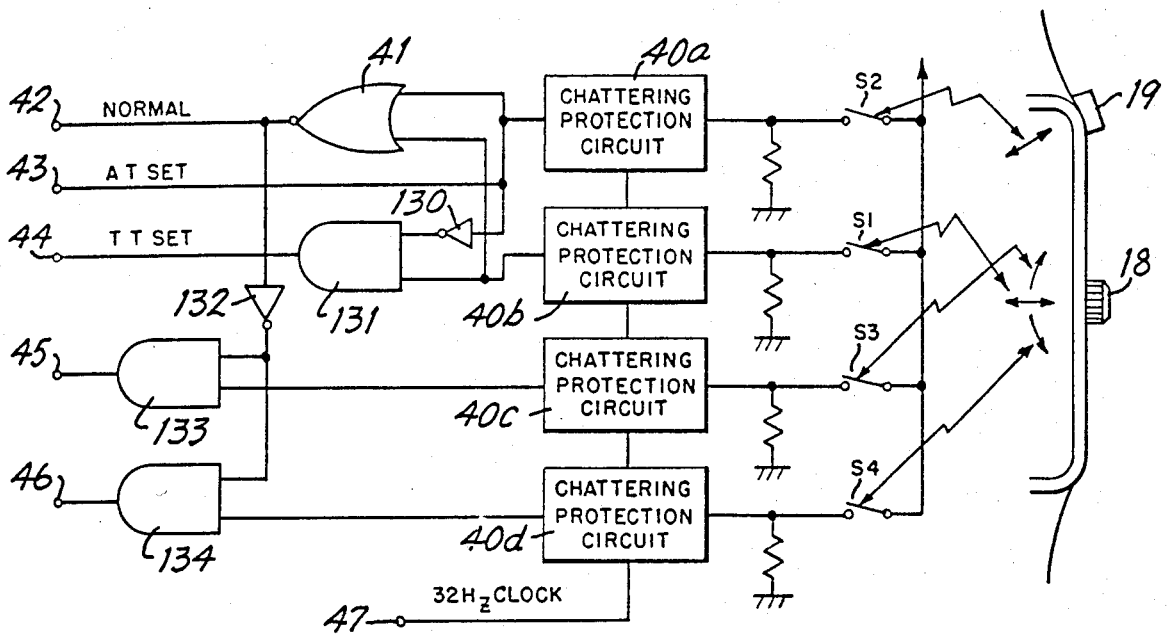
FIG. 11 is a circuit arrangement of one example of an input circuit for processing the signals from an operation section.

FIG. 11 illustrates an input circuit which is arranged between the operation sectin 12 and the control circuit 11. A switch $S_1$ is turned on when the winding stem 18 is pulled-out. A switch $S_3$ is turned on when the winding stem 18 is rotated in the reverse or opposite direction, and a switch $S_4$ is turned on when the winding stem 18 is rotated in the forward direction. A switch $S_2$ is turned on when the button 19 is pulled-out. Input signal waveforms from the switches are respectively applied to chattering protection circuits 40*a*, 40*b*, 40*c* and 40*d* to shape these input signal waveforms, and wave-shaped signals are produced therefrom in synchronization with a signal of 32 Hz applied to a clock input terminal 47. The output from the chattering protection circuit 40*a* is applied to a NOR gate 41, an inverter 130 and a terminal 43. The output from the chattering protection circuit 40*b* is applied to the NOR gate 41 and an AND gate 131. The output from the inverter 130 is applied to the AND gate 131, and the output from the NOR gate 41 is applied to a terminal 42 and an inverter 132. The output from the AND gate 131 is applied to a terminal 44, and the output from the inverter 132 is applied to AND gates 133 and 134. The outputs from the chattering protection circuits 40*c* and 40*d* are applied to the input terminals of the AND gates 133 and 134, respectively . The outputs from the AND gates 133 and 134 are applied to a terminal 44 and a terminal 45, respectively. The signals appearing on the terminals 42, 43 and 44 represent the operation states in the operation section 12. The relationships among each of the states of the switches and the signal level conditions of the terminals are shown in Table 1.

TABLE 1

| terminal | $S_1$ OFF | | $S_1$ ON | |
|---|---|---|---|---|
| | $S_2$ OFF | $S_2$ ON | $S_2$ OFF | $S_2$ ON |
| 42 | H | L | L | L |
| 43 | L | H | L | L |

TABLE 1-continued

| ter- | $S_1$ OFF | | $S_1$ ON | |
|---|---|---|---|---|
| minal | $S_2$ OFF | $S_2$ ON | $S_2$ OFF | $S_2$ ON |
| 44 | L | L | H | L |

The level of the terminal 42 becomes high in the condition of the present time display state, the level of the terminal 43 becomes high in the condition of the alarm time display/set state, and the level of the terminal 44 becomes high in the condition of the present time correction state. These high level states appear relatively and exclusively.

Figure 12:
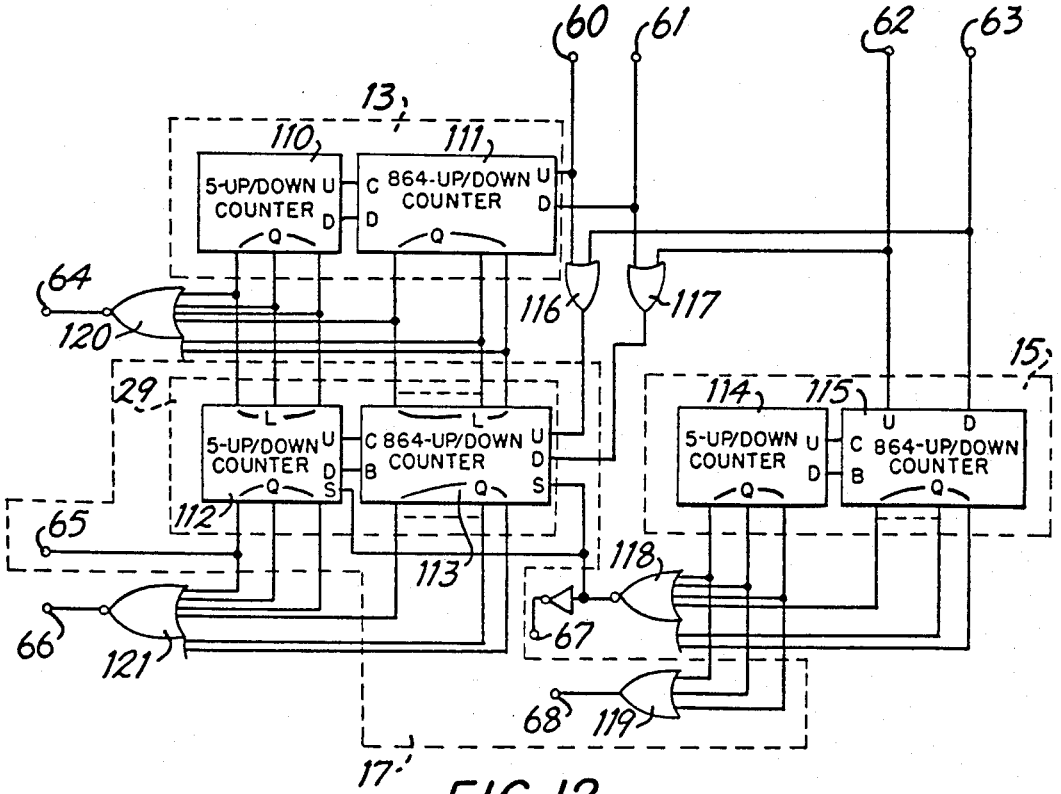
FIG. 12 is a circuit arrangement showing one example of a memory circuit and a discriminating circuit.

A more detailed description of the time difference counter 13, the display-time difference counter 15 and the discriminating circuit 17 will be described in conjunction with FIG. 12.

The time difference counter 13, the display-time difference counter 15 and a counter 29 forming part of the discriminating circuit 17 are 4320-counters. Each of the 4320-counters consists of 864-up/down counters 111, 113 and 115, and 5-up/down counter 110, 112 and 114, respectively, as shown in FIG. 12. The carry signal terminals C of the 864-counters are connected to the up-terminals U of the 5-counters corresponding thereto, and the borrow signal terminals B of the 864-counters are connected to the down-terminals D of the 5-counters corresponding thereto, respectively. Each 864-counter and corresponding 5-counter operates as 4320-counter. In addition, the counter 29 is presetable. A terminal 60 is connected to the up-input terminal U of the time difference counter 13 and an input terminal of an OR gate 116, and a terminal 61 is connected to the down-input terminal D of the time difference counter 13 and an input terminal of an OR gate 117. A terminal 62 is connected to the up-input terminal U of the display-time difference counter 15 and the other input terminal of the OR gate 117, and a terminal 63 is connected to the down-input terminal D of the display-time difference 15 and the other input terminal of the OR gate 116. The output terminals of the OR gates 116 and 117 are connected the up-input terminal U and the down-input terminal D of the counter 29, respectively. All of the binary-coded output terminals Q of the time difference counter 13 are connected to the input terminals of a NOR gate 120 and coresponding present data terminals L of the counter 29, and the output of the NOR gate 120 is connected to a terminal 64.

All of the binary-coded output terminals Q of the display-time difference counter 15 are connected to the input terminals of a NOR gate 118, and the binary-coded, output terminals of the 5-counter 114 are connected to the input terminals of an OR gate 119. The output terminal of the NOR gate 118 is connected to the present clock terminals S of the counter 29 and is connected to a terminal 67 via an inverter. The output terminal of the OR gate 119 is connected to a terminal 68.

All of the binary-coded output terminals Q of the counter 29 are respectively connected to the input terminals of a NOR gate 121, and the output terminal of the NOR gate 121 is connected to a terminal 66. The most significant digit of the binary-corded output from the 5-counter 112 is supplied to a terminal 65.

The arrangement of the circuit will be now described. The time difference counter 13 carries out a count up or down operation in accordance with the state of the pulses applied thereto from the terminals 60 and 61, and a zero detecting signal is produced from the terminal 64 when the content of the counter 13 becomes zero. The zero detecting signal is applied to the alarm circuit as a coincidence detecting signal which shows the fact that the present time is coincident with the present alarm time. The display-time difference counter 15 carries out the count up or down operation in response to the state of the pulses applied from the terminals 62 and 63 and when the content of the counter 15 becomes zero, a zero detecting signal appears on the terminal 67, and when the count content becomes more than 863, a magnitude detecting signal appears on the terminal 68. The content of the time difference counter 13 is transferred in the counter 29 when the content of the display-time difference counter 15 is zero. Then, the counters are operated as an up-counter by the application of the time difference counter-up signal from the terminal 60 and the display-time difference counter-down signal. The counters are also operated as a down counter by the application of the down signal for the time difference counter 13 from the terminal 61 and the up signal for the display-time difference counter 15 from the terminal 62.

As a result, the content of the counter 29 corresponds to the difference value between the contents of the time difference counter 13 and the display-time difference counter 15, that is, between the alarm time and the present time. When the content of the counter 29 becomes zero, that is, the alarm time is coincident with the present time, a coincidence detecting signal is produced from the terminal 66. The magnitude detecting signal is produced from the terminal 65 when the content of the counter 29 is more than 3456.

Now, the arrangement and the function of the control circuit 11 will be described.

Figure 13:
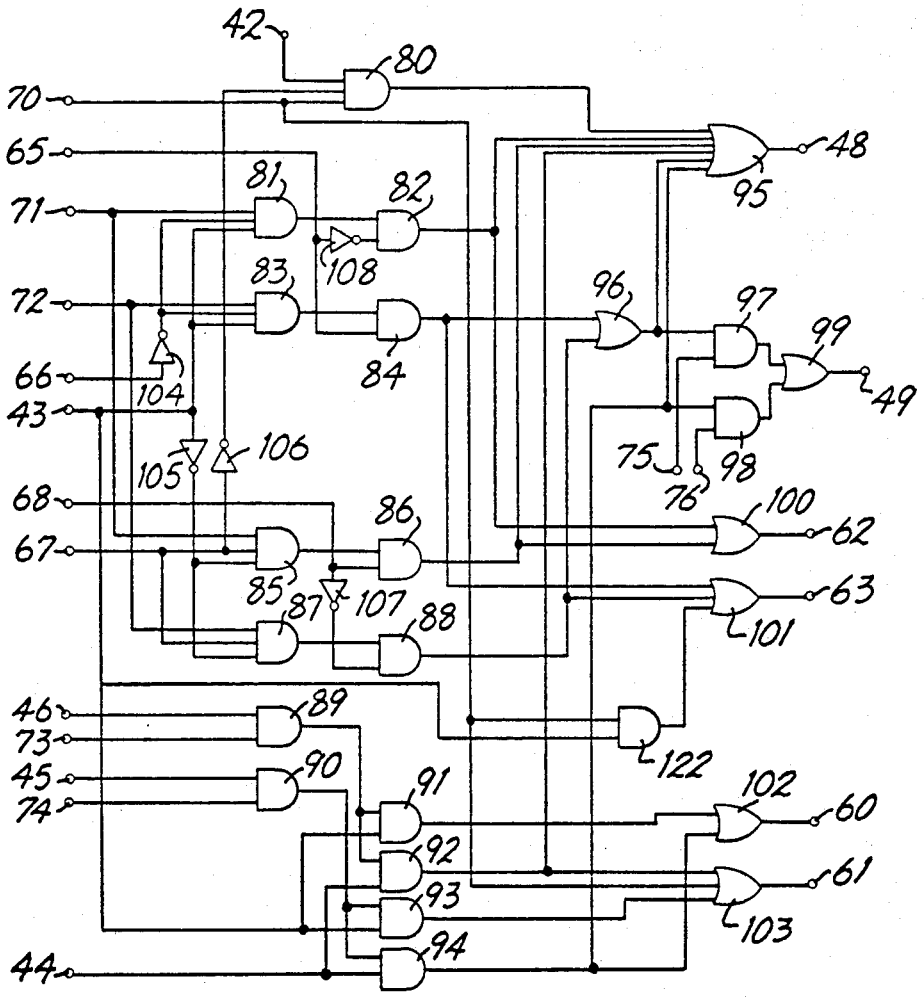
FIG. 13 is a circuit arrangement of one example of a control circuit.

The input terminals 42, 43, 44, 45 and 46 shown in FIG. 13 are connected to the corresponding output terminals of the input circuit shown in FIG. 11, respectively.

Figure 9:
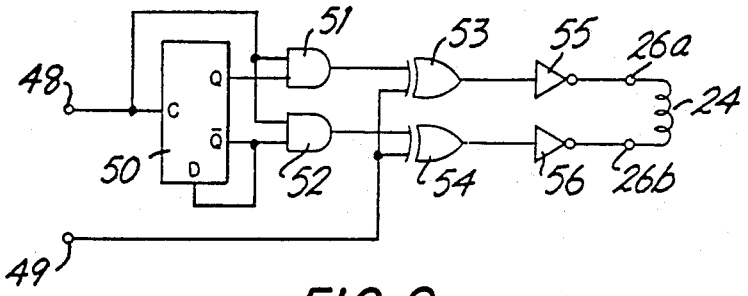
FIG. 9 is a circuit arrangement of one example of a driving circuit.

The terminals 48 and 49 are connected to the respective input terminals of the driving circuit shown in FIG. 9.

Figure 14:
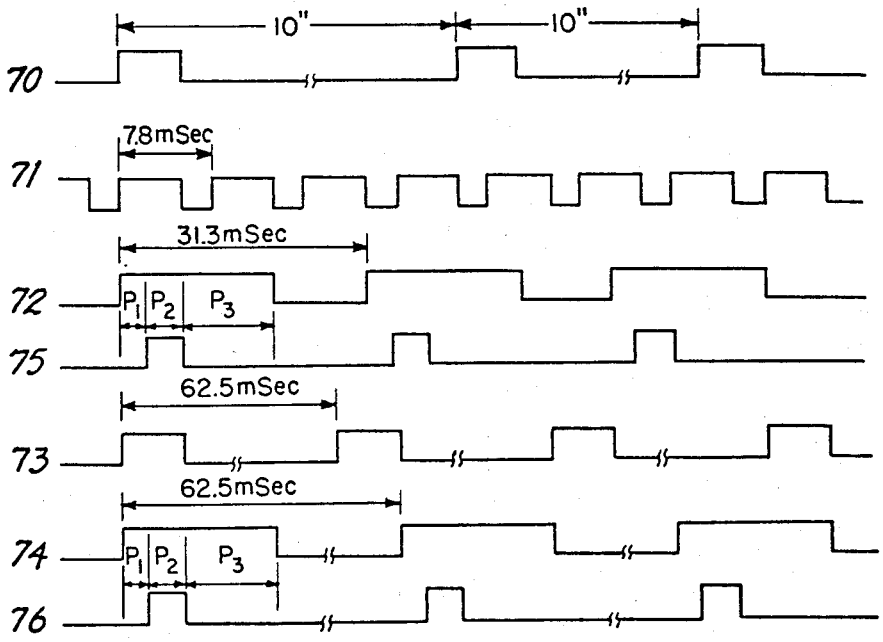
FIG. 14 illustrates a pulse waveform applied to the control circuit.

The terminals 70 through 76 are connected to the output terminals of the waveform synthesizing circuit (not shown) which produce signals with any desired waveforms by synthesizing the output signals from the frequency dividing circuit 2. The signals having the waveforms shown by the reference numerals 71 to 76 of FIG. 14 are continuously applied to these input terminals without the time from a timing pulse for moving the hands every 10 seconds, which is shown by the reference numeral 70 of FIG. 14, to the time of 31.3 (m sec).

The terminals 62, 63, 60, 61, 65, 66, 67 and 68 are connected to the memory 22 and the discriminating circuit 17.

In the normal operation, the level of the terminal 42 is high, and the level of the terminals 43 to 46 is low. Therefore, when the level of the terminal 67 is low, that is, the time being indicated by the hands coincides with the present time, the timing pulse for moving the hands every ten seconds, which is applied to the terminal 70, is supplied to the driving circuit. As a result, the motor is rotated in the forward direction every ten seconds, and the down-input signal for the time difference counter 13 is produced from the terminal 61. When the level of the terminal 67 is high, that is, the time being indicated by the hands is not coincident with the present time (when the hands are moving from the display position for indicating the alarm time to the display position for indicating the present time), the normal ten-second movement of the hands is stopped. In this case, when the level of the terminal 68 is high (when the content of the display-time difference counter 15 is more than 864, the pulses for moving the hands in the forward direction are supplied to the driving circuit, and the up signal for the display-time difference counter is produced from the terminal 62. The pulses for moving the hands in the forward direction comprise the pulses of 128/sec supplied from the terminal 71. When the level of the terminal 68 is low, that is, the content of the display-time difference counter is less than 864, the pulses for moving the hands in the reverse direction, which comprise the pulses of 32/sec supplied from the terminals 72 and 75, are applied to the driving circuit 3. At the same time, the down signal for the display-time difference counter 15 is output from the terminal 63. The moving operation of the hands is continued until the content of the display-time difference counter 15 becomes zero. Even if the hands are moving, the down signal for the time difference counter 13 is produced from the terminal 61 every one second.

In the present time correction state, the level of the terminal 44 is high and the level of the terminals 42 and 43 is low. At this time, pulses can be applied to the terminals 45 and 46 by rotating the winding stem.

In this condition, normal ten-second movement of the hands is stopped, and the level of the terminal 46 becomes high when the winding stem 18 is rotated in the forward direction. Therefore, the forward rotating correction pulse of 16 pulses/sec supplied from the terminal 73 is applied to the driving circuit 3, and the down signal for the time difference counter 15 is produced from the terminal 61. When the winding stem 18 is rotated in the opposite direction, the level of the terminal 45 becomes high, and the reverse rotating correction pulse supplied from the terminals 74 and 76 is applied to the driving circuit 3. At the same time, the up signal for the time difference counter 13 is produced from the terminal 60. Therefore, the present time is corrected, and the relative time difference between the alarm time and the present time is maintained at the exact value by using the time difference counter 13 as an up counter or a down counter.

In the alarm time display/set state, the level of the terminal 43 is high and the level of the terminals 42 and 44 is low. Therefore, pulses are applied to the terminals 45 and 46 by rotating the winding stem 18. In this condition the time hands are moved. Since the level of the terminal 65 is changed to a low level by the discriminating circuit 17 when the difference between the alarm time and the present time is less than 3456, the forward rotating pulses for moving the hands, which are pulses of 128 pulses/sec supplied from the terminal 71, are initially applied to the driving circuit 3, and the up signal for the display-time difference counter 15 is obtained from the terminal 62. When the difference between the alarm time and the present time is more than 3546, the level of the terminal 65 becomes high. Then, the pulses for moving the hands in the reverse direction, which are pulses of 32 pulses/sec suppled from the terminals 72 and 75, are applied to the driving circuit 3, and the down signal for the display-time difference counter 15 is produced from the terminal 63. Movement of the time hands is continued until the alarm time is coincident with the present time and the level of the terminal 66 becomes low.

After this operation, it is possible to correct the alarm time by rotating the winding stem 18. Since the level of the terminal 46 becomes high when the winding stem 18 is rotated in the forward direction, the forward rotating time correction pulses are obtained from the terminal 60 as the up signal for the time difference counter. As a result, the content of the time difference counter 13 becomes larger than that of the display-time difference counter 15 by one. Therefore, the time-indicating hands are moved in the forward direction, and the hands are advanced by one step. When the winding stem 18 is rotated in the opposite direction, the level of the terminal 45 becomes high so that the reverse rotating correction driving pulses supplied from the terminal 74 are obtained from the terminal 61 as the down signal for the time difference counter 13. As a result, the hands are moved in the reverse direction by one step.

Under the alarm time display/set state, the pulses for moving the hands every ten seconds are not produced. However, the down signal for the time difference counter 13 and the down signal for the display-time difference counter 15 are produced from the terminals 61 and 63 every ten seconds.

Since the watch has the above mentioned functions, it is possible to store the relative relationship among the alarm time, the present time and the display time. Consequently, as described above, when the present time display state is selected, the hands are moved until the content of the display-time difference counter 15 becomes zero, and the present time can be exactly displayed.

In accordance with the invention the present time and the alarm time can be displayed by using a single display mechanism by using the relative time differences among the present time, the alarm time and the display time. Although there are three relative time differences, if any two relative time differences are known, the remaining one can be calculated on the basis of the two known relative time differences. When the operating conditions and the combination of the relative time differences to be stored are properly decided, it is required to carry out only a relatively simple operation, such as detecting whether or not the relative time differences become zero, or detecting whether or not one relative time difference is coincident with the other relative time difference. Therefore, it is also possible to eliminate the necessity of calculating the remaining relative time difference. Hereinafter, two embodiments, wherein the above mentioned principles are employed, will be described.

Figure 15:
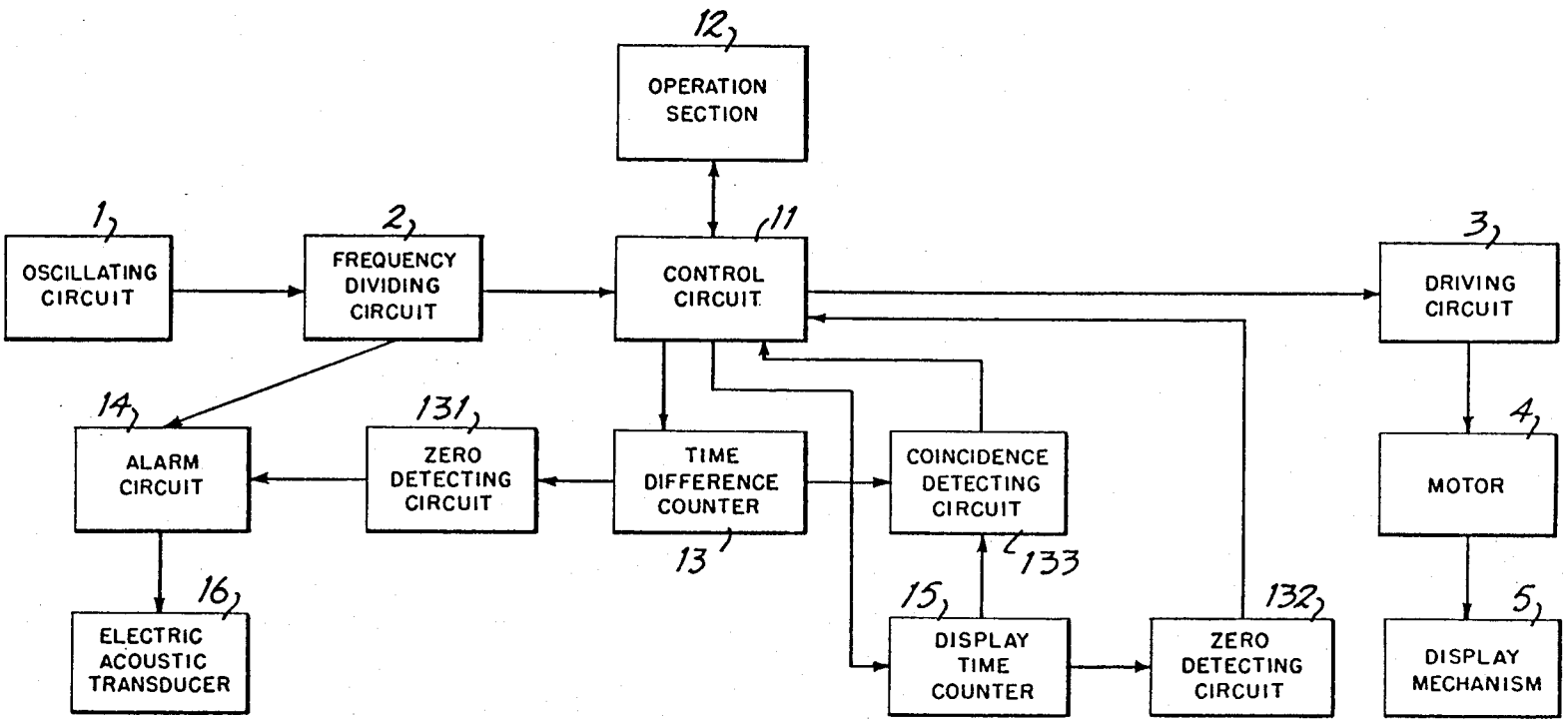
FIG. 15 is a block diagram of a second embodiment of the analogue alarm electric timepiece in accordance with the present invention.

FIG. 15 illustrates a block diagram of a second embodiment of the present invention.

The output from an oscillating circuit 1 is applied to a frequency dividing circuit 2, and the outputs from the circuit 2 are supplied to a control circuit 11 and an alarm circuit 14.

The control circuit 11 is connected to an operation section 12, a driving circuit 3, a time difference counter 13, a display-time counter 15, a coincidence detecting circuit 133 and a zero detecting circuit 132. The output from the driving circuit 3 is applied to a motor 4, and the mechanical output from the motor 4 is transmitted to a display mechanism 5. The output from the display-time difference counter 15 is applied to the coincidence detecting circuit 133 and the zero detecting circuit 132. The output from the time difference counter 13 is applied to the zero detecting circuit 131 the output of which is applied to an alarm circuit 14.

The operation of the embodiment will be generally described.

The time difference counter 13 is the counter in which the time difference between the present time and an alarm time is calculated and stored. The display-time difference counter 15 is the counter in which the time difference between the alarm time and the display time is calculated and stored.

In the case that the time-indicating hands are moved from the position indicating the present time to the position indicating the alarm time, the display-time difference counter 15 is counted down or up in response to the movement of the hands, and the hands are moved until the content of the counter 15 becomes zero. In the case that the hands are moved from the position indicating the alarm time to the position indicating the present time, the display-time difference counter 15 is counted down or up in response to the movement of the hands, and the hands are moved until the content of the counter 15 is coincident with the content of the time difference counter 11. When the present time is coincident with the alarm time, the content of the time difference counter 13 becomes zero, and a signal is applied to the alarm circuit 14 to produce an alarm second. The operation will be explained in more detail below.

Figure 16:
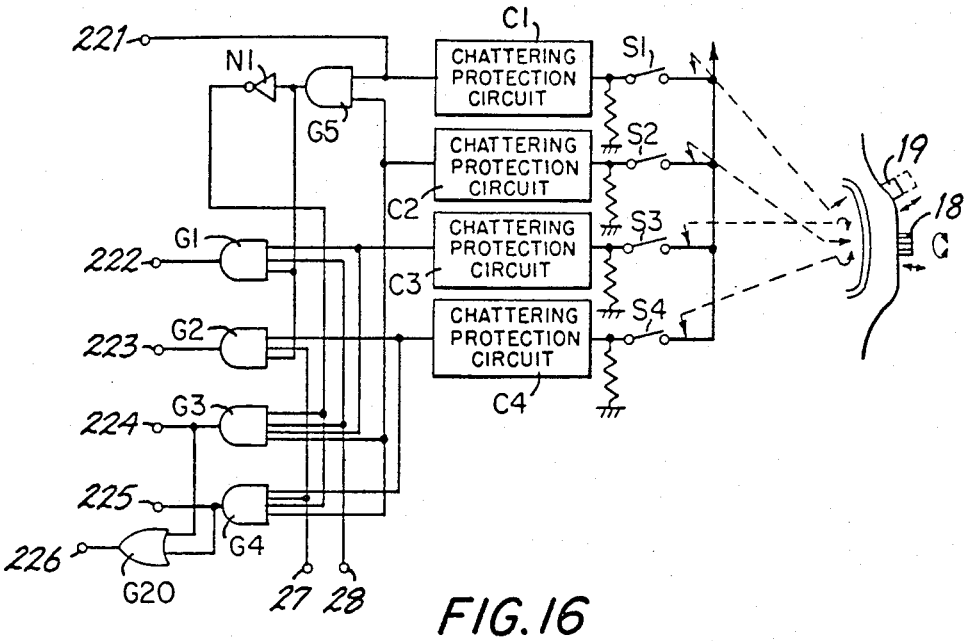
FIG. 16 is a circuit arrangement of one example of an input circuit for processing the signal from an operation section.

FIG. 16 illustrates a circuit diagram of the operation section 12 of the FIG. 15 embodiment. A set of input switches S1 to S4 are opened or closed by pulling-out the button 19 and/or the winding stem 18 or by rotating them. One of the terminals of the switches S1 to S4 is maintained at a high level. The other terminals of the switches S1 to S4 are respectively connected to the input terminals of chattering protection circuits C1 to C4 and are grounded through resistors. The output from the chattering protection circuit C4 is produced as an alarm display output 221 and the output is input to an AND gate G5. The output from the chattering protection circuit C2 is applied to the input terminals of AND gates G3, G4 and G5. Similarly, the output from the chattering protection circuit C3 is applied to the input terminals of AND gates G1 and G3, and the output from the chattering protection circuit C4 is applied to the input terminal of AND gates G2 and G4. A forward rotation quick feeding output 228 is applied via a terminal 28 to the output terminals of the AND gates G1 and G3, and a reverse rotation quick feeding output 227 is applied via a terminal 27 to the input terminals of the AND gates G2 and G4. The output of the AND gate 5 is connected to the inputs of the AND gates G1 and G2, and to the input of an inverter N1. The output from the inverter N1 is applied to the AND gates G3 and G4. The outputs from the AND gates G1 to G4 are used for a forward rotating output 222 for correcting the alarm time, a reverse rotating output 223 for correcting the alarm time, a forward rotating output 224 for correcting the present time, and a reverse rotating output 225 for correcting the present time, respectively. The outputs from the AND gates G3 and G4 are supplied to an OR gate G20, and the output from the OR gate G20 is used as a time correction driving output 226.

Figure 17:
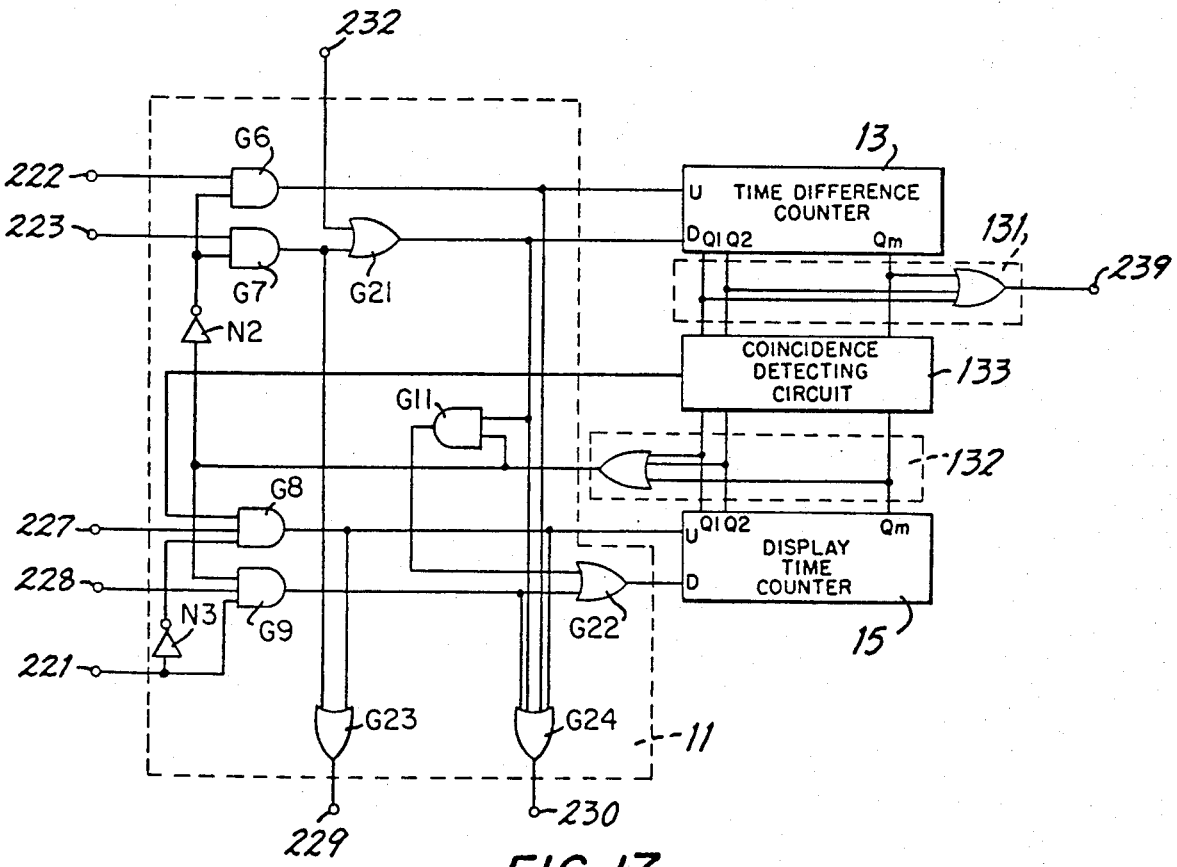
FIG. 17 is a circuit arrangement of one example of a control circuit, a time difference counter using as a memory, a display-time difference counter, a zero detecting circuit and a coincidence detecting device.

FIG. 17 illustrates a circuit diagram of the control circuit 11, a memory circuit including the time difference counter 13 and the display-time difference counter 15, the zero detecting circuit 131, the zero detecting circuit 132, the coincidence detecting circuit 133 and a circumferential circuit.

The output of an AND gate G6, to which are fed as inputs the forward rotating output 222 for correcting the alarm time and the output from an inverter N2, is connected to an up-count input of the time difference counter 13 and to the input of an OR gate G24.

The output from an AND gate G7, to which are fed as inputs the reverse rotating output 223 for correcting the alarm time and the output of the inverter N2, is input to an OR gate G21. The normal hand moving output 232 is applied to the other input of the OR gate G21. The output of the OR gate G21 is connected to the down-count input of the time difference counter 13 and to the input of the OR gate G24.

The time difference counter 13 and the display-time difference counter 15 are a 4320-counter and a 8640-counter, respectively, and the count capacity of these counters corresponds to twelve hours and twenty-four hours, respectively. These count numbers can be freely selected in accordance with the period of hand movement and the period of the alarm. The output of the coincident detecting circuit 133 can be obtained by carrying out the exclusive OR operation of the Q outputs in each of the stages of the display-time difference counter 15 and the time difference counter 13 (not shown).

The zero detecting circuit 131 carries out the OR operation of the Q output in each of the stages of the time difference counter 13 and the output therefrom is output as an alarm output 239.

The output of the coincidence detecting circuit 133 is connected to the input of an AND gate G8. The zero detecting circuit 132 consists of an OR gate to which is fed the Q output from each of the stages of the display-time difference counter 15, and the output thereof is connected to the inputs of the inverter N2, an AND gate G9 and an AND gate G11.

A reverse rotating quick feed output 227 and the output from an inverter N3, to which the alarm display output 221 is applied, are input to the input of the AND gate G8. The output of the AND gate G8 is connected to the up-count input of the display-time difference counter 15 and the input of the OR gate G24.

A forward rotating quick feed output 228 and the alarm display output 221 are input to the input of the AND gate G9, and the output thereof is connected to the input of the OR gate G24. The output of the AND gate G9 is also input to an OR gate G22 to which the output of the AND gate G11 is applied, and the output of the OR gate G21 and the output of the zero detecting circuit 132 are applied to the AND gate G11. The output of the OR gate G22 is connected to the down-count input of the display-time difference counter 15.

The outputs from the AND gates G7 and G8 are applied to an OR gate G23, and the output of the OR gate G23 is used as a reverse rotating output 229 for moving the time-indicating hands. The output of the OR gate G24 is likewise used as an output 230 for moving the hands.

Figure 18:
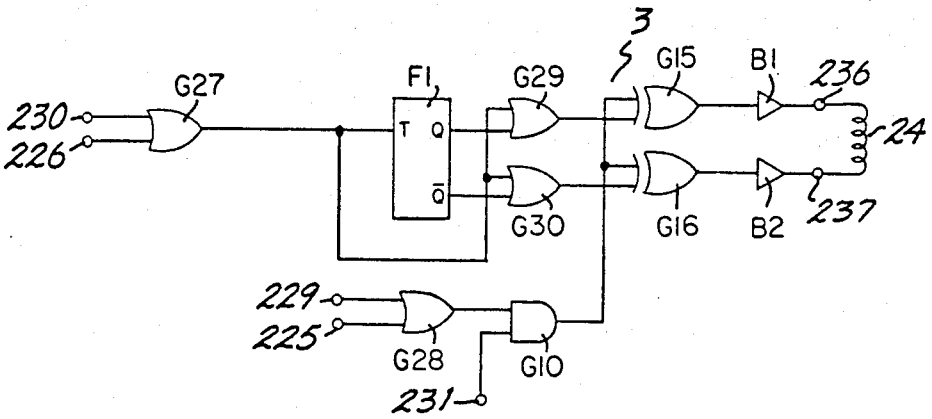
FIG. 18 is a circuit arrangement of one example of a motor driving circuit.

FIG. 18 is a circuit diagram of the motor driving circuit 3 of the FIG. 15 embodiment, and the circuit is arranged in such a way that the output of an OR gate G27, to which the output 230 for moving the time hands and the driving output 226 for correcting the present time are applied, is connected to a T input of a T flip-flop F1, and moreover, a Q output and a $\overline{Q}$ output of the T flip-flop F1 are input to OR gates G29 and G30, respectively.

The output of an OR gate G28, to which the reverse rotating output 229 for moving the hands and the reverse rotating output 225 for correcting the present time are applied, is applied to an AND gate G10 to which a pulse output 231 for reverse rotation is also input.

The output of the AND gate G10 is commonly input to Ex-OR gates G15 and G16 and moreover, the outputs of the OR gates G29 and G30 are respectively applied thereto. The outputs therefrom are used as motor driving outputs 236 and 237 through buffers B1 and B2.

The operation of this embodiment will be now described.

Figure 19:
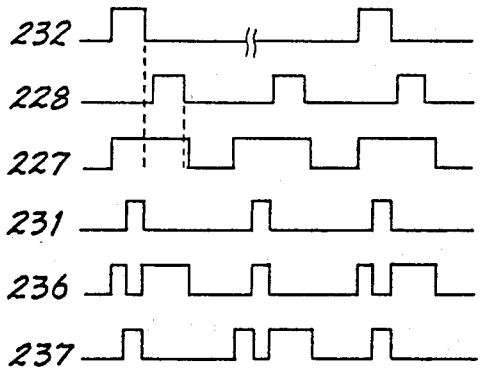
FIG. 19 is a time chart of the output pulse for driving a motor.

In the normal operation for the present time display state, as illustrated by a time chart of FIG. 19, a normal hand moving output 232 with a period of 10 seconds is applied to the motor driving circuit 3 through the OR gates G21, G24. As a result, the stepping motor 4 is driven, and the display mechanism 5 indicates the time in the ten-second mode in which the hands move every ten seconds.

The forward rotation quick feeding output 228 shown in FIG. 19 is a signal with a frequency of 32 Hz, and the pulse width of the signal is selected in view of the electric characteristic of the motor. The reverse rotation quick feeding output 227 has a frequency of 32 Hz, and is combined with the reverse rotating pulse output 231 to form the reverse rotation driving waveform for the motor 4. The motor driving outputs 236 and 237 in FIG. 19 show the motor driving waveform at the time of the reverse rotation.

Next, the method of alarm setting and the alarm operation will be described.

In the normal condition, that is, in the time display state, the content of the time difference counter 13, in which the difference between the alarm time and the present time is stored, is coincident with the content of the display-time difference counter 15, in which the difference between the alarm time and the display time is stored. Since the output level of the coincidence detecting circuit 133 is high when one counter content is not equal to the other counter content, the AND gate G8 is opened and the reverse rotation quick feeding output 227 is counted up in the display-time difference counter 15 until the output level of the circuit 133 becomes low, in other words, one content is equal to the other content.

The alarm setting operation will now be described. At first, the input switch S1 is closed when the button 19 is pulled-out, and the signal level of the alarm time display output 221 becomes high. As a result, the AND gate G9 is opened and the display-time difference counter 15 is counted down by the application of the forward rotation quick feeding output 228. The output 228 is also applied to the motor 4 through the OR gate G24 to rotate the motor in the forward direction.

For example, assuming that the present time is twenty minutes past one o'clock and the content of the display-time difference counter 15 and the time difference counter 13 is 180 (which corresponds to thirty minutes) before the operation, the display mechanism 5 is driven in the forward direction until the content of the display-time difference counter 15 becomes zero minute, that is, the output level of the zero detecting circuit 132 becomes zero to close the AND gate G9. At this time, it is ten minutes to two o'clock.

In this case, if it is required to set the alarm time to be two o'clock, the winding stem 18 should be furthermore pulled-out to change the output level of the AND gate G5 to the high level. As a result, when the signals from the input switches S3 and S4, which are operated by the rotation of the winding stem 18 in the right or left direction, are applied to the AND gates G1 and G2, the forward rotation and reverse rotation quick feeding outputs 227, 228 are output as the alarm time forward rotation and reverse rotation correcting outputs 222, 223. When the alarm set time corresponding to ten minutes should be advanced, the winding stem 18 is operated to close the input switch S3 in such a way that 60 pulses of forward rotation output 222 for correcting the alarm time, the 60 pulses correspond to ten minutes due to the fact that the hands move at ten-second increments, is output therefrom.

At this time, since the forward rotation output 222 for correcting the alarm time is supplied from the AND gate G6, the time difference counter 13 is counted up by the amount corresponding to ten minutes and the amount corresponding to forty minutes is stored therein.

During this time, after a lapse of more than ten seconds, pulses are applied by the application of the normal hand moving output 232 so that the time difference counter 13 is counted down. Therefore, the difference between the alarm set time and the present time is always stored in the time difference counter 13.

At this time, since the display mechanism 5 indicates two o'clock, which is the alarm time, and the amount corresponding to forty minutes is stored in the time difference counter 13, which content shows the difference between the alarm time and the present time, the operation described hereinafter is carried out in the case that the present time is indicated again, that is, the button 19 is returned to the its original position.

Returning the button 19 to its original pushed-in position makes the input switch S1 to open, and the level of output 221 for displaying the alarm time which is the output from the chattering protection circuit C1 becomes low. As a result, since the output level of the inverter N3 shown in FIG. 17 becomes high, the AND gate G8 is opened to produce the reverse rotation quick feeding output 227 as the up-count input for the display-time difference counter 15. At this time, the OR gates G23, G24 output the reverse rotation output 229 for moving the hands and the hand moving output 230 to rotate the motor 4 in the reverse direction.

The reverse rotation output 229 for moving the hands and the hand moving output 230 continue until the content of the time difference counter 13 is coincident with that of the display-time difference counter 15 so that the output level of the coincidence detecting circuit 133 becomes low to close the AND gate G8. Therefore, the display mechanism 5 is rotated in the reverse direction by the amount corresponding to forty minutes so that display time becomes the present time of twenty minutes past one o'clock, and the amount corresponding to forty minutes is stored in the display-time difference counter 15.

After this, since the time difference counter 13 and the display-time difference counter 15 are counted down by the application of the normal hand moving output 232 which is produced every ten seconds, the content of the time difference counter 13 becomes zero after a lapse of forty minutes which corresponds to the content of the time difference counter 13 which is used for indicating the difference between the alarm time and the present time. Consequently, the output level of the zero detecting circuit 131 becomes low to drive the alarm circuit 14, and the alarm sound is produced from the electric acoustic transducer 16.

At this time, the display mechanism 5 indicates two o'clock and the contents of the time difference counter 13 and the display-time counter 15 become zero.

Although displaying, recognizing and correcting for alarm time is carried out as described above, in the normal time correction, only the winding stem 18 shown in FIG. 16 is pulled-out to close the input switch S2, and the output level of the chattering protection circuit C2 becomes high.

Since the outputs from the chattering protection circuits C1 and C2 are applied to the AND gate G5, the output level of the AND gate G5 is maintained at low level and the output level of the inverter N1 becomes high. At this time, the forward rotation quick feeding output 228 and the reverse rotation quick feeding output 229 are derived from the AND gates G3 and G4 as the forward rotation output 224 for correcting the present time and the reverse rotation output 225 for correcting the present time in dependence on the ON-OFF conditions of the input switches S3 and S4 which are operates by rotating the winding stem 18 in the right or left direction. For this reason, the motor 4 is driven by the motor driving circuit 3 shown in FIG. 18 to correct the present time.

The driving output 226 for correcting the present time which is obtained by carrying out the OR operation between the forward rotation output 224 for correcting the present time and the reverse rotation output 225 for correcting the present time, and the hand moving output 230 which is obtained by carrying out the OR operation among the normal hand moving output 232 and the up inputs and down inputs for the time difference counter 13 and the display-time difference counter 15, are input to the OR gate G27 in the motor driving circuit 3. The OR gate G27 gathers all of the driving outputs for the motor 4 and the output thereof is applied to the T flip-flop F1. The T flip-flop F1 alternately distributes the output from the OR gate G27, which is the driving output for the motor 4, to the OR gates G29 and G30 in such a way that the output from the OR gate G27 can be used as the reverse rotation output for the motor 4.

Describing the operation of the reverse rotation of the motor, since the reverse rotation output 229 for moving the time-indicating hands which is obtained by carrying out the OR operation between the down input for the time difference counter 13 and the up input for the display-time difference counter 15 and the reverse rotation output 225 for correcting the present time, are input to the OR gate G28, the pulse is produced when the motor 4 is rotated in the reverse direction.

Since it is required that the reverse rotation pulse output 231 be produced at the same time when the reverse rotation quick feeding output 227 is applied to the motor 4, it is applied to the Ex-OR gates G15 and G16 through the AND gate G10 if the output of the OR gate G28 is produced.

The outputs of the Ex-OR gates G16 and G17, in this case, are illustrated as the motor driving outputs 236 and 237 shown in FIG. 19, and the motor 4 is rotated in the reverse direction by the application of these outputs.

In the forward rotating operation, the output level of the AND gate G10 is kept at a low level so that the outputs from the OR gates G29 and G30 are derived as the motor driving outputs 236 and 237.

Figure 20:
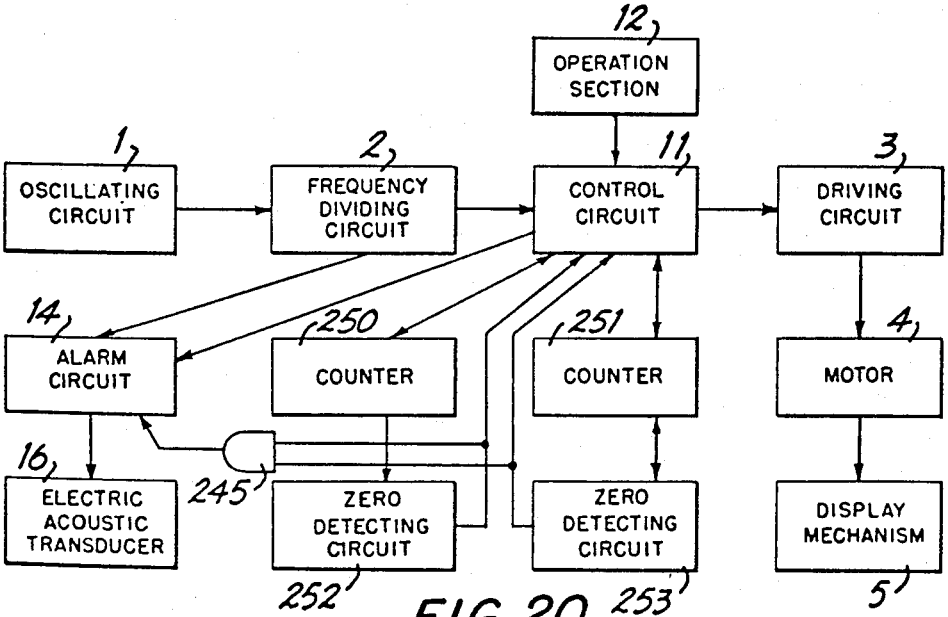
FIG. 20 is a block diagram of a third embodiment of the analogue alarm electronic timepiece in accordance with the present invention.

FIG. 20 illustrates a block diagram of a third embodiment of the present invention.

A counter 250 has the function of counting and storing the time difference between the display time and the present time, and the content of the counter 250 is increased or decreased at the time of the hand moving operation for changing a display time or at the time of the alarm time correction. The content of the counter 250 is decreased by one at every regular hand movement timing in the display state other than the present time display state. A counter 251 stores the time difference between the display time and the alarm time, and the content of the counter 251 is increased or decreased at the time of the hand moving operation for changing a display time or at the time of the correcting operation for the present time. The content of the counter 251 is increased by one at every regular hand moving timing used in hand moving for displaying the present time in the present time display state.

The operation of the FIG. 20 embodiment will be described.

When it is required to move the time indicating hands from the position corresponding to the present time to the position corresponding to the alarm time, at first, whether or not the content of the counter 251 being more than a predetermined value is discriminated, the hands are moved in such a direction that the moving time is minimized. At the same time, each of the contents of the counters 250 and 251 is increased or decreased, and the hand moving operation is continued until the content of the counter 251 becomes zero. In the operation for correcting the alarm time, the content of the counter 251 is maintained at zero and the counter 250 is counted up or down in accordance with the movement of the hands. During this time, the counter 250 is counted down by one at every regular hand movement timing.

When it is required to change the display mode to the present time display state, the moving direction of the hands is decided according to the content of the counter 250. The counters 250 and 251 count down or up in accordance with the movement of the hands, and the hand moving operation is continued until the content of the counter 250 becomes zero. In the operation for correcting the present time, the content of the counter 251 is maintained at zero and the counter 250 is counted up or down. The counter 251 is counted up by one at every regular hand movement timing. As a result, the time when the counters 250 and 251 become zero indicates the time when the alarm time is coincident with the present time. Therefore, if the AND operation is carried out between the outputs from zero detecting circuits 252 and 253 in an AND gate 245, it is possible to detect the alarm time.

As will be seen from the above mentioned second and third embodiments, if only two sets of the relative time differences each of which is obtained by selecting any two times from the group consisting of the present time, the alarm time and the display time, are stored, it is not necessary to calculate the remaining relative time difference.

Although these embodiments are described by taking the case of an analogue alarm electronic watches to which the most simple specifications are required, the present invention is likewise applicable to analogue alarm electronic watches which have more complex and a higher degree of functions. Although the timepieces having two time hands which are moved every ten seconds are shown in the disclosed embodiments, the present invention is also applicable to other types of the analogue alarm electronic watches.

It is a very important feature of the present invention that the operations for correcting the time are not carried out mechanicaly, but are carried out by the use of an electronic circuit. If the operations for correcting the time are carried out by the use of the any mechanism, such as a sliding mechanism, it follows that the display time is not changed in connection with the contents of the relative time differences stored in the electronic circuit. Although, in order to solve this drawback, it might be possible to use a mechanism which inputs the information of the display time by indicating the hands or the moving amount of the hands to the electronic circuit; however, to do so, the mechanism of the watch of the present invention becomes complex so that the advantages of the present invention will be lost.

In the above described embodiments, all of the electronic circuits are realized by the use of fixed logic circuits, however, the electronic circuits can be realized by the use of the logic operation processing circuit employing the stored program system. In this case, although the description in this specification does not describe such a stored program system, it should be noted that the timepiece employing the logic operation processing circuit is in the scope of the present invention.

As described above, according to the present invention, it is possible to provide an analogue alarm electronic timepiece in which only a simple mechanism is required without the need of a complex additional mechanism, such as a coincidence detecting mechanism which is complex and low in reliability, so that it is possible to provide a timepiece having reliability and commercial worth.

What is claimed is:

1. An analogue alarm electronic timepiece comprising: a motor; a driving circuit for applying drive signals to said motor for driving said motor; an operation section having switch means for setting an alarm time and a present time and for producing corresponding time signals; control means for receiving the time signals from said operation section and accordingly controlling the drive signals applied to said driving circuit; display means including a movable display member driven by said motor for indicating said alarm time and said present time; first means for counting and storing a count value representative of the difference between said present time and said alarm time under control of said control means; second means for counting and storing a count value representative of the difference between said present time and the display time indicated by said display member under control of said control means; first detecting means connected to said first means for detecting the difference between said present time and said alarm time and for producing a coincidence signal when the difference is zero; second detecting means connected to said second means for detecting the difference between said present and said display time; and an electronic acoustic transducer operative in response to the coincidence signal produced by said first detecting means for producing an alarm sound.

2. An analogue alarm electronic timepiece as claimed in claim 1; further comprising a discriminating circuit connected to said first means and coacting with said control means to determine whether said motor rotates in a forward or reverse direction.

3. An analogue alarm electronic timepiece as claimed in claim 1; wherein said first detecting means includes a first zero detecting circuit and said second detecting means includes a second zero detecting circuit.

4. An analogue alarm electronic timepiece comprising: a motor; a driving circuit for applying drive signals to said motor; an operation section having switch means for setting an alarm time and a present time and for producing corresponding time signals; control means for receiving the time signals from said operation section and accordingly controlling the drive signals applied to said driving circuit; display means including a movable display member driven by said motor for indicating said alarm time and said present time; first means for counting and storing a count value representative of the difference between said present time and the display time indicated by said display member under control of said control means; second means for counting and storing a count value representative of the difference between said display time and said alarm time under control of said control means; first zero detecting means connected to said first means; second zero detecting means connected to said second means for detecting when the difference between said display time and said alarm time is zero and producing a corresponding output signal; and an electronic acoustic transducer operative in response to the output signal of said second zero detecting means for producing an alarm sound.

* * * * *